US006639485B2

(12) United States Patent
Hasegawa et al.

(10) Patent No.: US 6,639,485 B2
(45) Date of Patent: Oct. 28, 2003

(54) NONRECIPROCAL CIRCUIT DEVICE AND COMMUNICATION DEVICE USING SAME

(75) Inventors: Takashi Hasegawa, Kanazawa (JP); Masakatsu Mori, Ishikawa-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/732,540

(22) Filed: Dec. 8, 2000

(65) Prior Publication Data

US 2001/0020877 A1 Sep. 13, 2001

(30) Foreign Application Priority Data

Dec. 9, 1999 (JP) ..... 11-349951

(51) Int. Cl.[7] ..... H01P 1/36; H01P 1/365
(52) U.S. Cl. ..... 333/24.2; 333/1.1
(58) Field of Search ..... 333/1.1, 24.2

(56) References Cited

U.S. PATENT DOCUMENTS

| | | | | |
|---|---|---|---|---|
| 3,895,320 A | | 7/1975 | Katoh | 333/1.1 |
| 4,236,125 A | * | 11/1980 | Bernard et al. | 333/1.1 |
| 5,495,210 A | * | 2/1996 | Forterre et al. | 333/1.1 |
| 5,619,080 A | | 4/1997 | Pennington et al. | 307/105 |
| 6,020,793 A | | 2/2000 | Makino et al. | 333/1.1 |

FOREIGN PATENT DOCUMENTS

| | | | | |
|---|---|---|---|---|
| EP | 0903802 A2 | | 3/1999 | |
| EP | 0 948079 | | 10/1999 | |
| FR | 2 671 912 A1 | * | 7/1992 | 333/1.1 |
| JP | 50-122145 | | 9/1975 | |
| JP | 56-167617 | | 4/1981 | |
| JP | 9093003 | | 4/1997 | |
| JP | 10079607 | | 3/1998 | |
| JP | 10-93308 | | 10/1998 | |
| JP | 11239009 | | 8/1999 | |

OTHER PUBLICATIONS

Krauss et al., Solid State Radio Engineering, 1980, Wiley & Sons, New York, NY, pp. 39.*

* cited by examiner

*Primary Examiner*—Benny Lee
*Assistant Examiner*—Stephen E. Jones
(74) *Attorney, Agent, or Firm*—Keating & Bennett, LLP

(57) ABSTRACT

A compact, inexpensive nonreciprocal circuit device which provides a large attenuation in a particular frequency band, and a communication device incorporating the same. A series resonance circuit in which an inductor and a capacitor are connected in series to each other is connected between a first port of a central conductor and the ground, capacitors are connected between the ground and a second and a third ports of other central conductors and the ground, and a terminating resistor is connected to the third port.

8 Claims, 5 Drawing Sheets

NONRECIPROCAL CIRCUIT DEVICE AND COMMUNICATION DEVICE USING SAME

BACKGROUND OF THE INVENTION

1. Field of the Invention

The present invention relates to nonreciprocal circuit devices and to communication devices. More particularly, the present invention relates to a nonreciprocal circuit device, such as an isolator and a circulator, for use in the high frequency band such as the microwave band, and to a communication device incorporating the same.

2. Description of the Related Art

Nonreciprocal circuit devices, such as lumped constant isolators and lumped constant circulators, are used in communication devices such as cellular phones, taking advantage of the characteristics that the devices exhibit a very small attenuation with respect to the direction of signal transmission, and a very large attenuation with respect to the reverse direction.

As shown in an equivalent circuit in FIG. 8, a lumped constant isolator typically includes three central conductors L disposed on a magnetic body (ferrite) so as to intersect with one another, matching capacitors C0 connected between the ground and respective ports P1, P2 and P3 of the central conductors L, and a terminating resistor R connected to the port P3, DC magnetic field Hex being applied to the magnetic body and the central conductors. The magnetic body is indicated by a broken line in FIG. 8.

In a typical communication device, amplifiers incorporated in the circuit inevitably generates some distortion, causing spurious radiations such as the second and the third harmonic components of the fundamental wave. Rules and standards are provided, dictating the spurious radiations be kept below a particular level. The spurious radiations can be prevented with amplifiers with good linearity; however, such amplifiers are rather expensive. A common alternative method is to provide a filter or the like so as to attenuate undesired frequency components. However, use of such filters increases cost and the size of the communication device, and also causes loss.

Furthermore, in the communication device, isolators and circulators are used for stable operation and protection of amplifiers in the circuit. Particularly, lumped constant isolators and lumped constant circulators exhibit band-pass filter characteristics in the forward direction, attenuating signals, even in the forward direction, in frequency bands off the pass band. However, the conventional nonreciprocal circuit device having the basic construction as shown in FIG. 8 has failed to provide sufficient attenuation within the undesired frequency band.

Japanese Unexamined Patent Application Publications Nos. 10-93308 and 10-79607 each disclose a nonreciprocal circuit device which provides a large attenuation in the frequency band of spurious radiations, particularly the second and third harmonic components of the fundamental wave. In the nonreciprocal circuit devices disclosed therein, in addition to the construction shown in FIG. 8, an inductor is provided on an input port or an output port, and a capacitor is externally connected, thereby constituting a low-pass filter. Thus, the components of the undesirable frequency band is attenuated to reduce the spurious radiations, the overall communication device can be constructed more compact compared to an arrangement in which a separate filter is externally provided.

However, in the nonreciprocal circuit devices disclosed in the Japanese Unexamined Patent Application Publications Nos. 10-93308 and 10-79607, one inductor and one or two capacitors are required to constitute a low-pass filter, raising problems that the number of parts is increased, and that setting of the inductance and capacitance values is sensitive, thus inhibiting reduction in size and in cost. That is, addition of discrete capacitors increases the number of parts and the cost. On the other hand, use of a mounting board and matching capacitors involves restrictions regarding the characteristic values of each of the components, rendering the design difficult. Furthermore, the capacitors for filtering purpose provided parallel to the matching capacitors results in an increased size. In addition, an inductor of a relatively large inductance value is required to constitute the low-pass filter.

SUMMARY OF THE INVENTION

Accordingly, it is an object of the present invention to provide a compact, inexpensive nonreciprocal circuit device which provides a large attenuation in a particular frequency band, and a communication device incorporating the same.

To this end, a nonreciprocal circuit device according to the present invention includes a magnetic unit which receives DC magnetic field, said magnetic unit having a plurality of central conductors disposed so as to intersect with one another; and a series resonance circuit constituted of an inductor and a capacitor, having a resonance frequency higher than the operating frequency of the nonreciprocal circuit device, connected between the ground and a port section of one of the plurality of central conductors used as an input or output port. More specifically, an inductor is connected in series to a conventional matching capacitor so as to form a series resonance circuit on the port section of one of the central conductors used as an input or output port. Whether the series resonance circuit is connected to either the input port or the output port, or to both the input and output ports, is determined in accordance with the desired shape (size), attenuation, etc.

In the above construction, the series resonance circuit constituted of the inductor and the capacitor forms a trap having a pole at a frequency higher than the operating frequency of the nonreciprocal circuit device, providing a large attenuation in the frequency band higher than the operating frequency, and attenuating undesired radiations of the second and third harmonic components of the fundamental wave (the operating center frequency).

Thus, by having the series resonance circuit serve as both a matching circuit and a band stop filter, a separate filter for preventing the undesired radiations, components of the filter, an LC series resonance circuit, etc. need not be externally provided. Thus, the number of parts can be reduced, and the nonreciprocal circuit device and the communication device can be implemented in a reduced size and in a reduced cost.

Furthermore, in accordance with the construction, the values of the capacitance and the inductance can be reduced compared with those of the low-pass filter in the Japanese Unexamined Patent Application Publication No. 10-93308, and the nonreciprocal circuit device can be further reduced in size.

Generally, the attenuation of the second harmonic component is smaller than that of the third harmonic component in the nonreciprocal circuit device, and thus, the undesired radiations are most effectively suppressed when the resonance frequency of the series resonance circuit is in the vicinity of the frequency of the second harmonic component. This resonance frequency is preferably between the frequency of the fundamental wave and that of the third harmonic component.

The series resonance circuit can be formed without increasing the number of parts by integrally forming the inductor constituting the series resonance circuit with the central conductors, and in addition, the cost can be reduced.

The communication device of the present invention includes the nonreciprocal circuit device having the above-described characteristics. A compact, inexpensive communication device which provides preferable characteristic.

DESCRIPTION OF THE PREFERRED EMBODIMENTS

Figure 1:
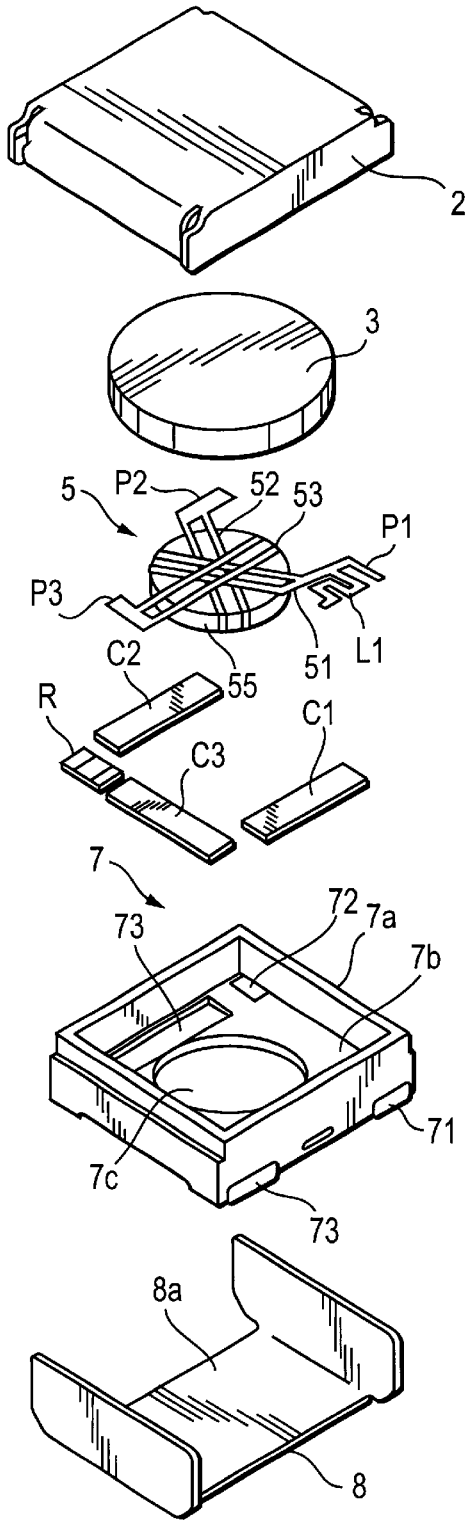
FIG. 1 is an exploded perspective view of an isolator according to a first embodiment of the present invention.

The construction of an isolator according to a first embodiment of the present invention will be described with reference to FIGS. 1 to 3. FIG. 1 is an exploded perspective view of the isolator, FIG. 2 is a top plan view of the isolator with the top yoke removed therefrom, and FIG. 3 is an equivalent circuit diagram thereof.

Figure 2:
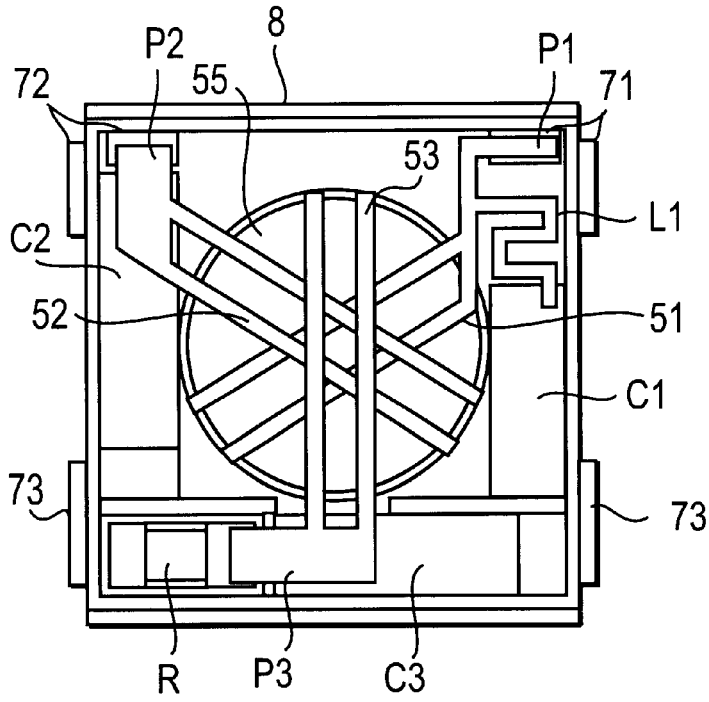
FIG. 2 is a top plan view of the isolator according to the first embodiment with the top yoke removed therefrom.
Figure 3:
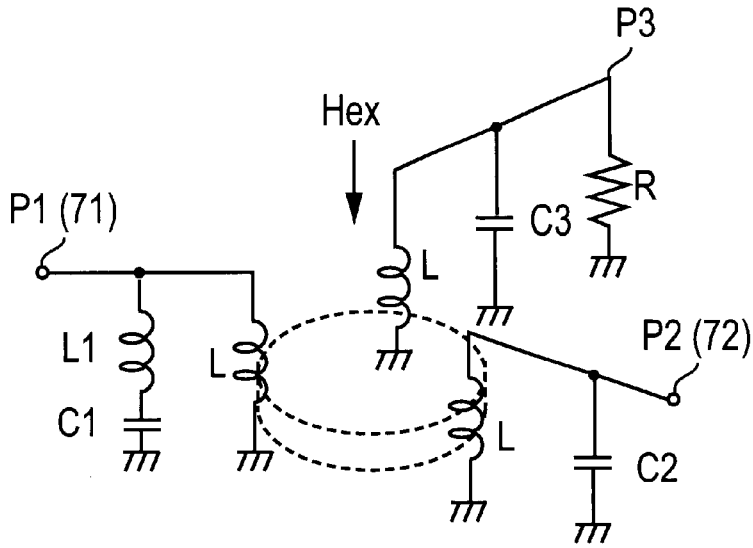
FIG. 3 is an equivalent circuit diagram of the isolator according to the first embodiment.

As shown in FIGS. 1 and 2, the isolator includes a box-shaped top yoke 2 formed of magnetic metal, a disc-shaped permanent magnet 3 disposed on an inner face of the top yoke 2, a substantially U-shaped bottom yoke 8 similarly formed of magnetic metal, the top yoke 2 and the bottom yoke 8 constituting a closed magnetic circuit, a resin case 7 disposed on the bottom face 8*a* of the bottom yoke 8, a magnetic assembly 5 to which DC magnetic field is applied by the permanent magnet 3, matching capacitors C1, C2 and C3, and a terminating resistor R.

The magnetic assembly 5 includes a disc-shaped magnetic body 55 and three central conductors 51, 52 and 53. A common ground section of the three central conductors 51, 52 and 53 is abutted on the bottom face of the magnetic body 55. Furthermore, the three central conductors 51 to 53 are folded and disposed on the top face of the magnetic body 55, with insulating sheets (not shown) interposed therebetween, so as to form an angle of 120 degrees with respect to one another. Port sections P1, P2 and P3 on forward end sides of the central conductors 51 to 53 are projected outwardly. The central conductors 51 to 53 are formed by punching a metal conductor sheet formed of, for example, copper, and have a circular ground section as a common ground terminal, and are provided so as to project outwardly from this ground section with a specified angular interval (120 degrees) between one another.

In the isolator, the forward end portion of the central conductor 51 is machined narrow in a meander shape, and an inductor L1 having a specified inductance value is integrally formed with the port section P1 of the central conductor 51.

The resin case 7 is formed of an electrically insulating material. A bottom wall 7*b* is integratedly formed with a side wall 7*a* of rectangular frame shape, and input/output terminals 71 and 72 and a ground terminal 73 are provided so as to be partially embedded in the resin. A through hole 7*c* is formed in a substantially center portion of the bottom wall 7*b*, and the magnetic assembly 5 is inserted in the through hole 7*c*. Ground sections of the central conductors 51 to 53 on the bottom face of this magnetic assembly 5 are connected to the bottom face 8*a* of the bottom yoke 8 by, for example, soldering. One end of each of the input/output terminals 71 and 72 and the ground terminal 73 is exposed to the top face of the bottom wall 7*b*, and the other end thereof is exposed to the bottom face of the bottom wall 7*b* and an outer face of the side wall.

Disposed around the circumferential edge of the through hole 7*c* are the chip-type matching capacitors C1, C2 and C3, and the chip-type terminating resistor R. The port sections P1 and P2 of the central conductors 51 and 52 are connected to the input/output terminals 71 and 72. The bottom electrodes of the capacitors C1 to C3 and the electrode on one side of the terminating resistor R are connected to the ground terminals 73 and 73, respectively. The top electrode of the capacitor C1 is connected to a forward end portion of the inductor L1 formed on the port section P1 of the central conductor 51. The top electrodes of the capacitors C2 and C3 are connected to the port sections P2 and P3 of the central conductors 52 and 53, and the other end of the terminating resistor R is connected to the port section P3.

Thus, in the isolator, as shown in the equivalent circuit diagram in FIG. 3, a series resonance circuit in which the inductor L1 is connected in series to the capacitor C1 is connected between the port P1 of the central conductor 51 and the ground, the capacitors C2 and C3 are connected between the ground and the respective ports P2 and P3, and the terminating resistor R is connected to the port P3. In FIG. 3, the magnetic body is indicated by a broken line, the DC magnetic field is indicated as Hex, the central conductors 51 to 53 are represented by an equivalent inductor L, and other symbols correspond to the ones used in FIGS. 1 and 2.

The series resonance circuit constituted of the inductor L1 and the capacitor C1 functions as a trap, and suppresses undesired radiations of the second and third harmonic components of the fundamental wave. The inductance of the inductor L1 and the capacitance of the capacitor C1 are determined so that the resonance frequency is higher than the operating frequency of the isolator. Generally, the attenuation of the second harmonic component is smaller than that of the third harmonic component. Therefore, in order to provide a large attenuation for the second harmonic component, the resonance frequency is set within a range between the frequencies of the fundamental wave and of the third harmonic component, with considerations for other characteristics including the pass band width and the isolation characteristics.

Figure 4:
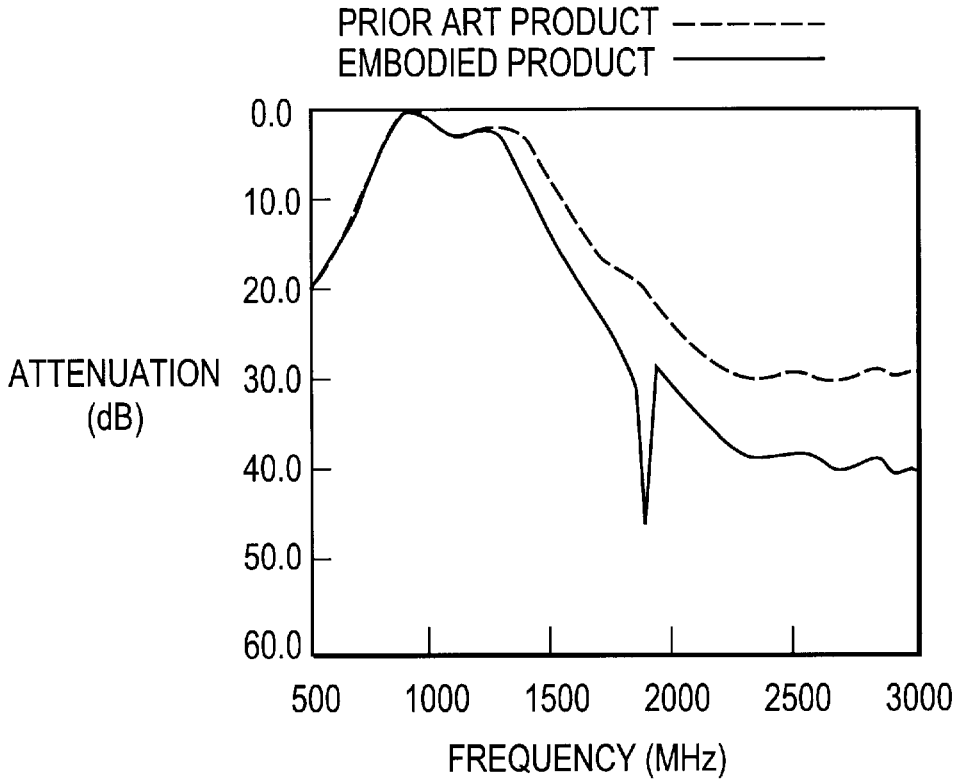
FIG. 4 is a graph showing the attenuation frequency characteristics of the isolator according to the first embodiment and of a conventional isolator.
Figure 8:
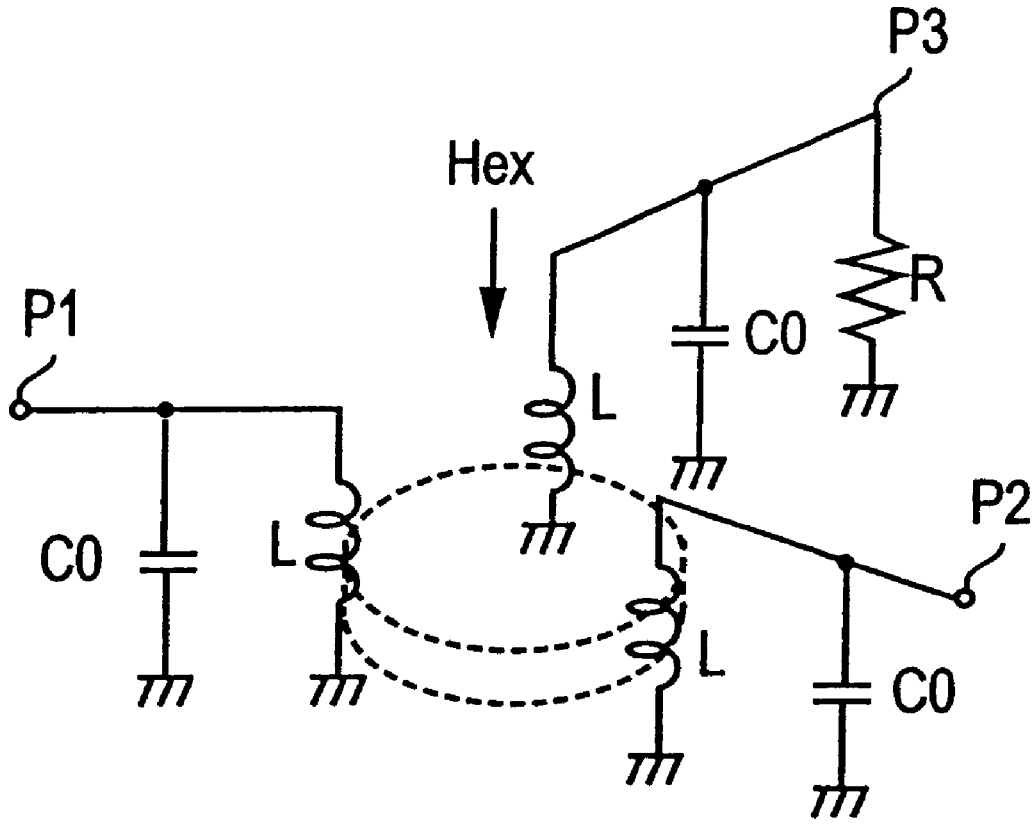
FIG. 8 PRIOR ART
FIG. 8 is an equivalent circuit diagram of the conventional isolator.

The advantage of the present embodiment is described below. FIG. 4 shows the attenuation characteristics with respect to the direction of transmission in the isolator according to the present embodiment (the construction in FIG. 3) and in the conventional isolator (the basic construction in FIG. 8), the solid line indicating the characteristics of the present embodiment, and the broken line indicating the characteristics of the conventional isolator. The overall dimensions are substantially 7.0 mm in width, 7.0 mm in depth, and 2.0 mm in height, and the frequency of the fundamental wave (the operating center frequency) is set to 900 MHz, and, for example, the inductance of the inductor L1 is set to be approximately 1.1 nH, and the capacitance of the capacitor C1 is set to be approximately 6.7 pF. Thus, the resonance frequency of the series resonance circuit is approximately 1.9 GHz. The capacitance of the capacitors C2 and C3 and that of capacitors C0 in the conventional isolator are set to be 9.0 pF.

As shown in FIG. 4, an attenuation pole is formed in the resonance frequency of the series resonance circuit in the embodiment, and the attenuation in the frequency range higher than frequency of the fundamental wave is higher compared with the conventional isolator. More specifically, the attenuation of the second harmonic component is approximately 19 dB and the attenuation of the third harmonic component is approximately 28 dB in the conventional isolator, while the attenuation of the second harmonic component is approximately 30 dB and the attenuation of the third harmonic component is approximately 39 dB in the present embodiment, achieving an improvement of approximately 11 dB for both components.

Figure 5:
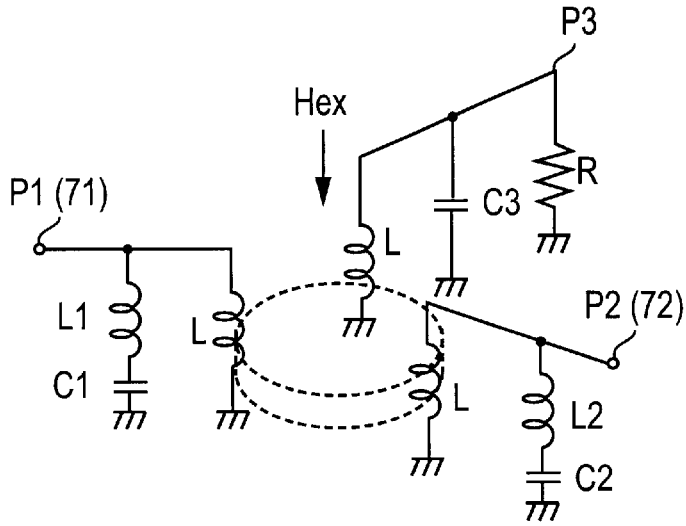
FIG. 5 is an equivalent circuit diagram of an isolator according to a second embodiment of the present invention.

FIG. 5 shows the construction of a nonreciprocal circuit device according to a second embodiment. In the above-described first embodiment, the series resonance circuit constituted of the inductor and the capacitor is connected to either an input port or an output port of the isolator; on the other hand, in the isolator shown in FIG. 5, a series resonance circuit constituted of the inductor L1 and the capacitor C1 is connected between the input port P1 and the ground, and a series resonance circuit constituted of the inductor L2 and the capacitor C2 is connected between the output port P2 and the ground. The resonance frequencies for both series resonance circuits are set to be higher than the operating frequency of the isolator.

Figure 6:
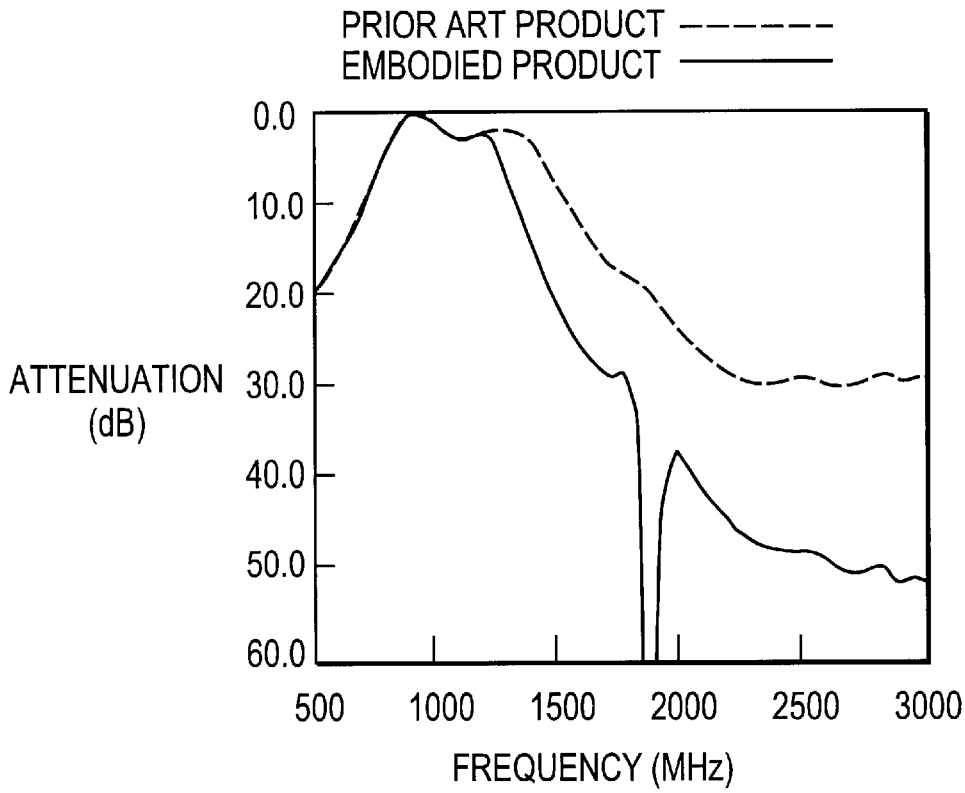
FIG. 6 is a graph showing the attenuation frequency characteristics the isolator according to the second embodiment and of the conventional isolator.

The advantage of the present embodiment is described below. FIG. 6 shows the attenuation characteristics with respect to the direction of transmission in the isolator of the present embodiment (the construction in FIG. 6) and in the conventional isolator (the basic construction in FIG. 8). The inductance of the inductors L1 and L2 is set to be approximately 1.1 nH, the capacitance of the capacitors C1 and C2 is set to be approximately 6.7 pF, and other values are set to be the same as in the first embodiment.

As shown in FIG. 6, the attenuation in the frequency range higher than the frequency of the fundamental wave is even larger than the attenuation in the first embodiment. More specifically, the attenuation of the second harmonic component is approximately 33 dB, and the attenuation of the third harmonic component is approximately 50 dB, achieving an improvement of approximately 14 dB and 22 dB, respectively, compared with the attenuation in the conventional isolator. By connecting the series resonance circuit to both the input and output ports, the attenuation in the frequency band higher than the operating frequency is further increased.

In the setting in FIG. 6, inductors and capacitors of the same inductance and capacitance values are used at the input port and the output port. Alternatively, inductors and capacitors of different inductance and capacitance values may be used so that the resonance frequencies of the series resonance circuits are different from each other. In this case, two attenuation poles are formed in the frequency range higher than the operating frequency, providing a variety of attenuation characteristic as desired.

In the above-described embodiments, the present invention can be applied to a circulator without connecting the terminating resistor R to the port P3.

In the above-described embodiments, the inductor L1 constituting the series resonance circuit is integrally formed of the same material as the central conductors 51 to 53; however, it is not limited thereto, other types of inductor element such as chip inductor and solenoid coil may be used, and the inductor may be formed by fabricating an electrode pattern on or inside a dielectric substrate. In particular, in a structure in which a spacer is used to stably hold components, the series resonance circuit can be formed without increasing the number of parts if the inductor is formed on or in the spacer.

The structure of the nonreciprocal circuit device is not limited to that of the first embodiment, and may be such that the central conductor is formed of an electrode film inside or on a dielectric or magnetic body. The number of parts need not be increased in this case either if the inductor is formed on or in a laminated substrate.

Figure 7:
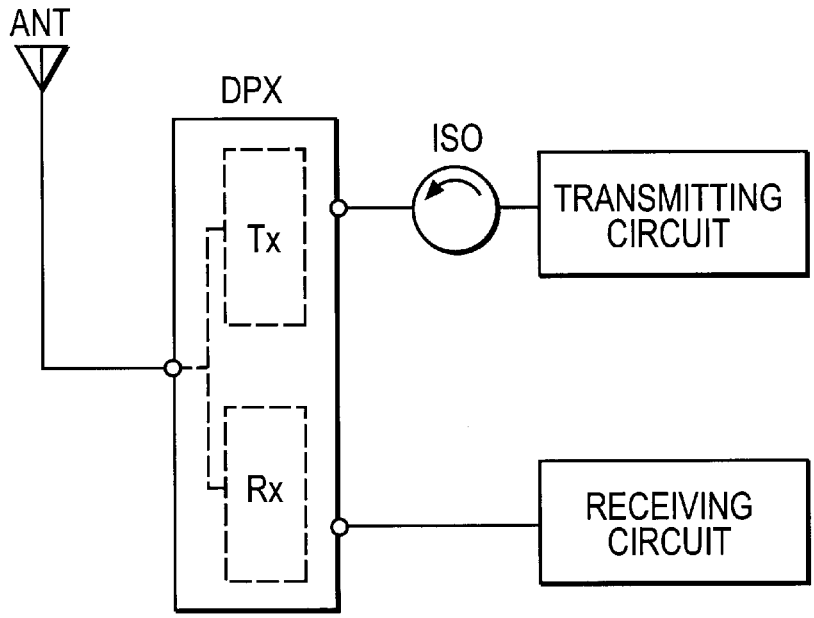
FIG. 7 is a block diagram of a communication device according to a third embodiment of the present invention.

FIG. 7 shows the construction of a communication device according to a third embodiment of the present invention. In this communication device, an antenna ANT is connected to an antenna terminal of a duplexer DPX having a transmitting filter TX and a receiving filter RX, an isolator ISO is connected between an input end of the transmitting filter TX and a transmitting circuit, and a receiving circuit is connected to an output end of the receiving filter RX. The transmission signal from the transmitting circuit is transmitted to the antenna ANT via the isolator ISO and the transmitting filter TX. The reception signal received by the antenna ANT is fed to the receiving circuit via the receiving filter RX.

The isolator of the above-described embodiment can be used as the isolator ISO. A compact, inexpensive communication device which provides preferable characteristics is thus obtained by using the nonreciprocal circuit device according to the present invention.

What is claimed is:

1. A nonreciprocal circuit device comprising:

a magnetic unit which receives DC magnetic field, said magnetic unit having a plurality of central conductors disposed so as to intersect with one another;

a series resonance circuit constituted of an inductor and a capacitor, having a resonance frequency higher than the operating frequency of said nonreciprocal circuit device, connected between the ground and a port section of one of said plurality of central conductors used as an input or output port; and a terminating resistor; wherein said terminating resistor is connected to a port section of one of said plurality of central conductors which is not connected to said series resonance circuit.

2. A nonreciprocal circuit device according to claim 1, wherein said resonance frequency of said series resonance circuit is set to be lower than the frequency of the third harmonic component of the operating frequency of the nonreciprocal circuit device.

3. A nonreciprocal circuit device according to one of claims 1 and 2, wherein said inductor constituting said series resonance circuit is integrally formed of the same material as said plurality of central conductors.

4. A communication device comprising a nonreciprocal circuit device according to claim 3.

5. A communication device comprising a nonreciprocal circuit A communication device comprising a non reciprocal circuit ice according to one of claims 1 and 2.

6. A nonreciprocal circuit device according to one of claims 1 and 2, wherein said series resonance circuit does not resonate in a passband of said nonreciprocal circuit device.

7. A nonreciprocal circuit device according to one of claims 1 and 2, wherein said series resonance circuit is connected only to said port section of said one of said plurality of central conductors.

8. A nonreciprocal circuit device according to one of claims 1 and 2, further comprising a second series resonance circuit constituted of an inductor and a capacitor, having a resonance frequency higher than the operating frequency of said nonreciprocal circuit device, connected between the ground and a port section of another of said plurality of central conductors used as an input or output.

* * * * *